US009145010B2

(12) United States Patent
Thomas et al.

(10) Patent No.: US 9,145,010 B2
(45) Date of Patent: Sep. 29, 2015

(54) PRINTERS AND PRINTER SYSTEMS FOR PRINTING IMAGES ON PAPER IN DIFFERENT CONFIGURATIONS AND FOR DISPENSING PRINTED PAPER IN DIFFERENT DIRECTIONS

(71) Applicant: Toshiba Global Commerce Solutions Holdings Corporation, Tokyo (JP)

(72) Inventors: Jeff D. Thomas, Raleigh, NC (US); Brad M. Johnson, Raleigh, NC (US); Richard H. Harris, Raleigh, NC (US); Hye Suk Makley, Morrisville, NC (US); Stacy Arrington, Morrisville, NC (US); Kimberly Wood, Raleigh, NC (US); Sharon Freedman, Cary, NC (US); Alecia Ellison, Morrisville, NC (US)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 0 days.

(21) Appl. No.: 14/197,538

(22) Filed: Mar. 5, 2014

(65) Prior Publication Data

US 2015/0145915 A1 May 28, 2015

Related U.S. Application Data

(60) Provisional application No. 61/907,673, filed on Nov. 22, 2013.

(51) Int. Cl.
*B41J 29/38* (2006.01)
*B41J 13/00* (2006.01)

(52) U.S. Cl.
CPC ..... *B41J 13/0009* (2013.01)

(58) Field of Classification Search
CPC ..... B41J 11/42; B41J 29/393; B41J 29/38; B41J 3/60; B41J 11/0095
USPC ..... 347/16, 101, 104
IPC ..... B41J 11/42, 29/393, 29/38, 3/60, 11/0095
See application file for complete search history.

(56) References Cited

U.S. PATENT DOCUMENTS

| | | | | |
|---|---|---|---|---|
| 4,531,852 | A * | 7/1985 | Madge et al. | 400/692 |
| 4,669,029 | A | 5/1987 | Svenson et al. | |
| 5,164,570 | A | 11/1992 | Okimura | |
| 7,891,893 | B2 | 2/2011 | Sekino et al. | |

(Continued)

OTHER PUBLICATIONS

PCT Search Report and Written Opinion regarding PCT/US14/65330, mailed Apr. 13, 2015.

*Primary Examiner* — Manish S Shah
*Assistant Examiner* — Yaovi Ameh
(74) *Attorney, Agent, or Firm* — Olive Law Group, PLLC

(57) ABSTRACT

Printers and printer systems for printing images on paper in different configurations and for dispensing printed paper in different directions are disclosed herein. According to an aspect, a printer includes a body defining openings. A printing unit is positioned within the body and can receive an instruction for printing an image. In a first print mode, the printing unit can print the image on the paper in a first configuration and dispense the paper in a first direction through one of the openings of the body. In the second print mode, the printing unit can print the image on the paper in a second configuration and dispense the paper in a second direction through another of the openings of the body. A sensing component can determine whether the printer is in the first print mode or the second print mode.

19 Claims, 5 Drawing Sheets

(56) References Cited

U.S. PATENT DOCUMENTS

| | | | | |
|---|---|---|---|---|
| 7,971,989 | B2 | 7/2011 | Sasaki | |
| 2001/0046397 | A1* | 11/2001 | Yoshinaga et al. | 399/400 |
| 2002/0141806 | A1 | 10/2002 | Endo et al. | |
| 2006/0028491 | A1 | 2/2006 | Horrocks | |
| 2009/0033699 | A1* | 2/2009 | Han | 347/12 |
| 2009/0227436 | A1* | 9/2009 | Takahashi | 493/420 |
| 2012/0188589 | A1* | 7/2012 | Potter | 358/1.15 |
| 2012/0224017 | A1 | 9/2012 | Nihashi | |
| 2012/0224201 | A1 | 9/2012 | Asahina | |

* cited by examiner

PRINTERS AND PRINTER SYSTEMS FOR PRINTING IMAGES ON PAPER IN DIFFERENT CONFIGURATIONS AND FOR DISPENSING PRINTED PAPER IN DIFFERENT DIRECTIONS

CROSS REFERENCE TO RELATED APPLICATION

This application claims the benefit of U.S. Provisional Patent Application No. 61/907,673, filed Nov. 22, 2013 and titled PRINTERS AND PRINTER SYSTEMS FOR PRINTING IMAGES ON PAPER IN DIFFERENT CONFIGURATIONS AND FOR DISPENSING PRINTED PAPER IN DIFFERENT DIRECTIONS, the content of which is hereby incorporated herein by reference in its entirety.

TECHNICAL FIELD

The present invention relates to paper printing, and more specifically, to printers and printer systems for printing images on paper in different configurations and for dispensing printed paper in different directions.

BACKGROUND

Printers are used in many environments. For example, printers are often used as peripheral devices at point of sale (POS) terminals. Depending on the POS environment, a printer may be either placed for rest on a surface, mounted on a wall surface, or placed underneath a counter. In other instances, a printer may be fitted within an enclosure such as a cabinet. Depending on the configuration in its environment, printed paper may be dispensed from the printer in an undesirable direction, location, or orientation. For example, if the printer is positioned within a cabinet with its front facing the opening of the cabinet, printed paper may dispense in a direction away from the cabinet opening, thus it may be difficult for the user to access the dispensed paper. As a result, the usefulness of the printer may be limited. Accordingly, it is desired to provide printers that can dispense paper more conveniently and that can be more easily configured.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein are printers and printer systems for printing images on paper in different configurations and for dispensing printed paper in different directions. According to an aspect, a printer includes a body defining one or more openings. The printer also includes a printing unit positioned within the body and configured to carry paper and to receive an instruction for printing an image. Further, the printing unit is configured to operate in either a first print mode or a second print mode. In the first print mode, the printing unit can print the image on the paper in a first configuration and dispense the paper in a first direction through the one or more openings of the body. In the second print mode the printing unit can print the image on the paper in a second configuration and dispense the paper in a second direction through the one or more openings of the body. The first and second configurations are different.

According to another aspect, a printer system includes a docking station comprising a printer interface and a printer holder. The printer system also includes a printer comprising a body having first and second sides that are each configured for carry by the printer holder.

According to another aspect, a printer system includes a docking station including a printer interface. The printer system also includes a printer including a body that defines an opening for dispense of printed paper. Further, the printer system includes a rotation mechanism attached to the docking station and the printer and configured to rotate the printer with respect to the docking station.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

Figure 1:
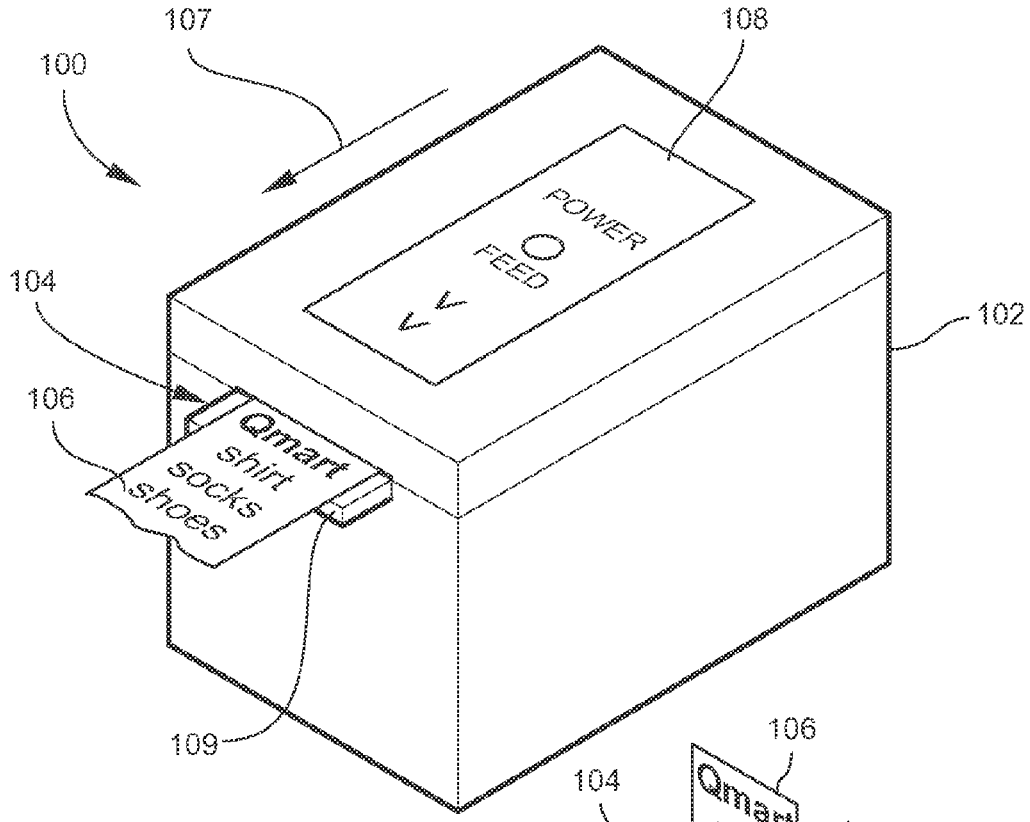
FIGS. 1 and 2 are perspective views an example printer in different print modes in accordance with embodiments of the present invention.

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

As referred to herein, the term "computing device" should be broadly construed. It can include any type of device including hardware, software, firmware, the like, and combinations thereof. A computing device may include one or more processors and memory or other suitable non-transitory, computer readable storage medium having computer readable program code for implementing methods in accordance with embodiments of the present invention. A computing device may be, for example, retail equipment such as POS equipment. In another example, a computing device may be a server or other computer located within a retail environment and communicatively connected to other computing devices (e.g., POS equipment or computers) for managing accounting, purchase transactions, and other processes within the retail environment. In another example, a computing device may be a mobile computing device such as, for example, but not limited to, a smart phone, a cell phone, a pager, a personal digital assistant (PDA), a mobile computer with a smart phone client, or the like. In another example, a computing device may be any type of wearable computer, such as a computer with a head-mounted display (HMD). A computing device can also include any type of conventional computer, for example, a laptop computer or a tablet computer. A typical mobile computing device is a wireless data access-enabled device (e.g., an iPHONE® smart phone, a BLACKBERRY® smart phone, a NEXUS ONE™ smart phone, an iPAD® device, or the like) that is capable of sending and receiving data in a wireless manner using protocols like the Internet Protocol, or IP, and the wireless application protocol, or WAP. This allows users to access information via wireless devices, such as smart phones, mobile phones, pagers, two-way radios, communicators, and the like. Wireless data access is supported by many wireless networks, including, but not limited to, CDPD, CDMA, GSM, PDC, PHS, TDMA, FLEX, ReFLEX, iDEN, TETRA, DECT, DataTAC, Mobitex, EDGE and other 2G, 3G, 4G and LTE technologies, and it operates with many handheld device operating systems, such as PalmOS, EPOC, Windows CE, FLEXOS, OS/9, JavaOS, iOS and Android. Typically, these devices use graphical displays and can access the Internet (or other communications network) on so-called mini- or micro-browsers, which are web browsers with small file sizes that can accommodate the reduced memory constraints of wireless networks. In a representative embodiment, the mobile device is a cellular telephone or smart phone that operates over GPRS (General Packet Radio Services), which is a data technology for GSM networks. In addition to a conventional voice communication, a given mobile device can communicate with another such device via many different types of message transfer techniques, including SMS (short message service), enhanced SMS (EMS), multi-media message (MMS), email WAP, paging, or other known or later-developed wireless data formats. Although many of the examples provided herein are implemented on smart phone, the examples may similarly be implemented on any suitable computing device, such as a computer.

As referred to herein, the term "user interface" is generally a system by which users interact with a computing device. A user interface can include an input for allowing users to manipulate a computing device, and can include an output for allowing the computing device to present information and/or data, indicate the effects of the user's manipulation, etc. An example of a user interface on a computing device includes a graphical user interface (GUI) that allows users to interact with programs or applications in more ways than typing. A GUI typically can offer display objects, and visual indicators, as opposed to text-based interfaces, typed command labels or text navigation to represent information and actions available to a user. For example, a user interface can be a display window or display object, which is selectable by a user of a computing device for interaction. The display object can be displayed on a display screen of a computing device and can be selected by and interacted with by a user using the user interface. In an example, the display of the computing device can be a touch screen, which can display the display icon. The user can depress the area of the display screen where the display icon is displayed for selecting the display icon. In another example, the user can use any other suitable user interface of a computing device, such as a keypad, to select the display icon or display object. For example, the user can use a track ball or arrow keys for moving a cursor to highlight and select the display object.

As referred to herein, the term "printer" should be broadly construed. It can include any type of device operable to make a representation of an electronic document on physical media. Exemplary printers include, but are not limited to, toner-based printers (e.g., laser printers), liquid inkjet printers, and solid ink printers. A printer may be a peripheral device for a computing device. For example, a printer may be communicatively connected to a point of sale computing device for printing receipts and other documents related to a retail transaction.

Figure 2:
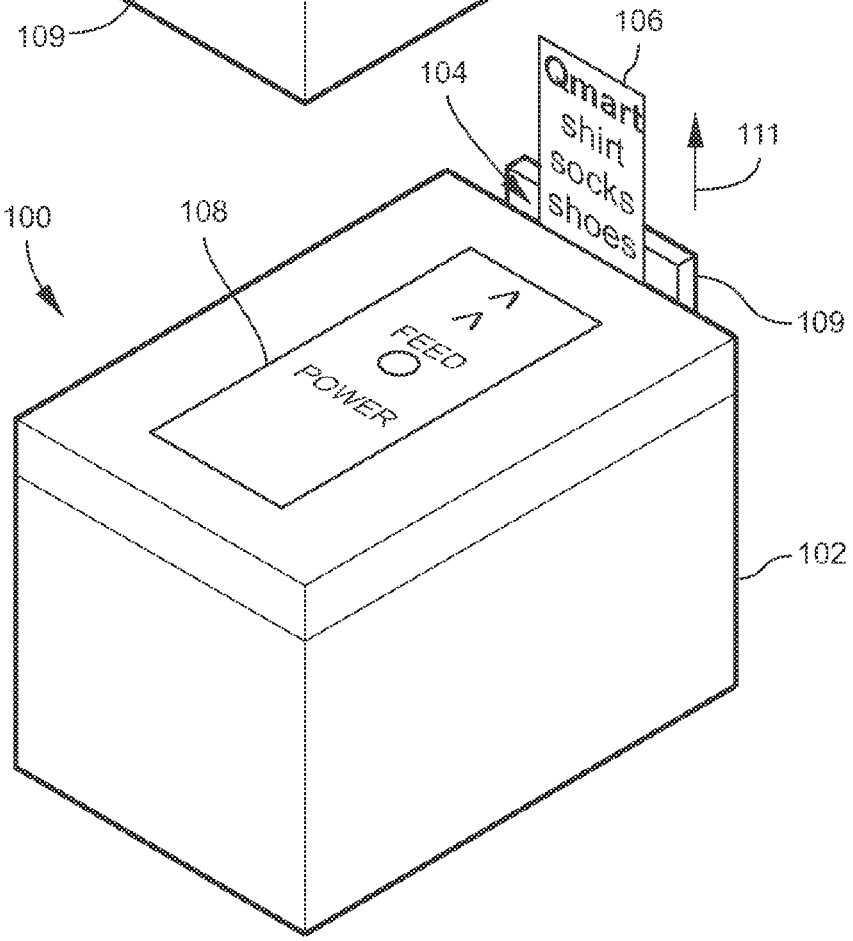

The presently disclosed invention is now described in more detail. For example, FIGS. 1 and 2 illustrate perspective views of an example printer 100 set in different print modes in accordance with embodiments of the present invention. Referring to FIG. 1, the printer 100 includes a body or cover 102 defining an opening 104. The printer 100 may include a printing unit (not shown) that is positioned within the body 102. The printing unit may include a print head (e.g., a thermal head) and any other suitable circuitry and hardware for receiving an instruction or data for printing an image on paper 106. For example, the printer 100 may include a roll of paper carried by a paper roll receiving unit (not shown). The printer 100 may include a feed mechanism configured to withdraw the paper from the paper rolling unit. In another example, the paper may be stacked within the printer 100, and a feed mechanism may pull sheets from the stack for positioning to print by the print head. The print head may be configured to print an image (e.g., lines of text or a picture) on the paper 106 as the paper 106 is withdrawn and guided by the feed mechanism. Subsequent to or during printing, an end of the paper 106 may be guided from inside the body 102 through the opening 104.

The printing unit may be configured to receive an instruction for printing an image on paper. For example, the printer 100 may be a peripheral device of a POS terminal. A computing device of the POS terminal may be configured to conduct a purchase transaction as will be understood. The purchase transaction may include printing a receipt and/or coupon for a customer. In this operation, the computing device may communicate to the printer 100 an instruction for printing an image on paper. For example, the instruction may specify multiple lines of text to print. The lines may include text identifying store information, products, purchase price, other transaction information, and the like.

In accordance with embodiments, the printer 100 may be configured to operate in either a first print mode or a second print mode. Configuration of the printer 100 in the first print mode is shown in FIG. 1, and configuration of the printer 100 in the second print mode is shown in FIG. 2. Referring to FIG. 1, the paper 106 is directed in the direction indicated by arrow 107, which indicates a direction of paper feed in the first print mode. The paper 106 can be guided and dispensed in the direction 107 by the paper guide/deflector 109 or any other suitable paper guide mechanism. As shown in this first print mode, the paper 106 is directed forward of the printer 100 with the text of the paper 106 generally facing upward.

Now referring to FIG. 2, the printer 100 is configured in the second print mode such that the paper 106 is directed in the direction indicated by an arrow 111. The paper 106 can be guided and dispensed in this direction 111 by the paper guide/deflector 109 or any other suitable paper guide mechanism. As shown in FIGS. 1 and 2, the paper 106 is dispensed in a lateral direction in the first print mode, and the paper 106 is dispensed in a vertical direction in the second print mode. In both the first and second print modes, the text on the paper 106 is upright for view by a user.

The dual functionality provided by the two print modes can be beneficial when the printer 100 is used in different situations. For example, if the printer 100 is placed on a counter, it may be desired to direct the paper in the vertical direction as shown in FIG. 2. If the printer 100 is placed within a cabinet or mounted under a counter, it may be desired to direct the paper in the lateral direction as shown in FIG. 1. In this example, a user may move the paper/guide deflector 111 in different orientations as shown in FIGS. 1 and 2 for changing between the two print modes. The printer 100 may be configured to detect the different orientations and change the print modes in response to detection of a change in orientation.

The printing unit is configured to, in the first print mode as shown in FIG. 1, print the image on the paper 106 in a first configuration and dispense the paper 106 through the opening 104. For example, FIG. 1 shows the paper 106 with multiple lines of text printed thereon. The print head printed the words in the following order: "shoes," "socks," "shirt," and "QMart." Further, the text is oriented for reading by a user when the paper 106 is dispensed towards the user in the direction 107.

Further, in the second print mode, the printing unit is configured to print the image on the paper 106 in a second configuration and dispense the paper 106 in a direction through the opening 104. For example, FIG. 2 shows the paper 106 with multiple lines of text printed thereon. The print head printed the words in the following order: "QMart," "shirt," "socks," and "shoes." Further, the text is oriented for reading by a user when the paper 106 is dispensed upward in the direction 111 and facing the user.

As shown in FIGS. 1 and 2, the configurations of the printed text are different. Particularly, in the first print mode, the printing is configured to control the print head to print the lines in the order and each line in an orientation as shown in FIG. 1 as the paper 106 is fed past the print head. In the second print mode, the printing unit is configured to control the print head to print the lines in the order and each line in an orientation as shown in FIG. 2 as the paper 106 is fed past the print head. The ordering is opposite and the first orientation opposes the second orientation as shown in FIGS. 1 and 2. In this way, the text is oriented to be conveniently read and received by a user in either the first print mode or second print mode.

The printer 100 may include a user interface 108 configured to present print operation information. The user interface 108 may receive user input for print operation control. In this example, the user interface 108 includes a display configured to display print operation information. Further, the user interface 108 is configured to display the print operation information in one orientation in one print mode, and to display the print operation information in another orientation in the other print mode as shown in FIGS. 1 and 2. As a result, the displayed information can properly face the operator in either print mode.

The printer 100 may be configured with one or more sensors for detecting a position of the paper guide/deflector 109. A print operation manager of the printer 100 may receive one or more signals from the sensor(s) and determine a print mode of the printer 100 based on the signal. For example, the signal(s) may indicate whether the paper guide/deflector 109 is in the position shown in FIG. 1 or the position shown in FIG. 2. The print operation manager may determine the print mode based on the signal(s). The print operation manager may include hardware, software, firmware, and combinations thereof. For example, the print operation manager may include one or more processors and memory. The print operation manager may control the display of the user interface 108 to be oriented in accordance with the print mode based on the detection of the position of the paper guide/deflector 109.

Figure 3:
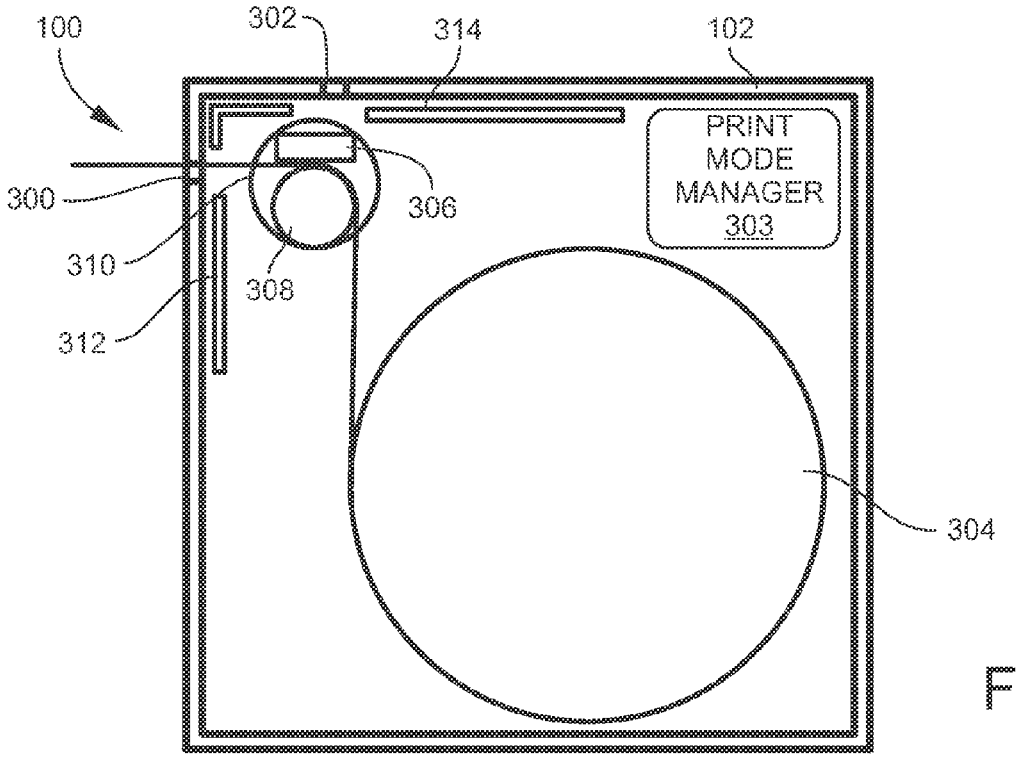
FIGS. 3 and 4 illustrate a side cross section view of another printer in accordance with embodiments of the present invention.
Figure 4:
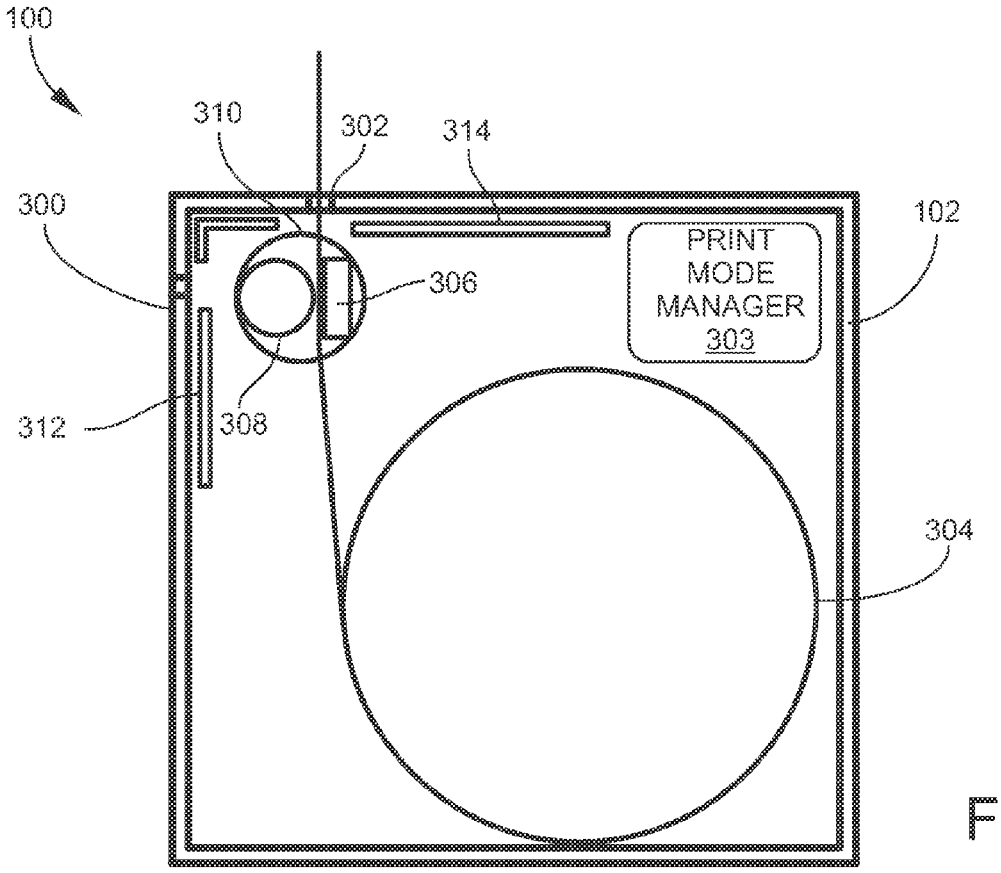

FIGS. 3 and 4 illustrate a side cross section view of another printer 100 in accordance with embodiments of the present invention. Referring to FIG. 3, the printer 100 includes the body 102 defining openings 300 and 302 on different sides of the body 102. A roll of paper 304 may be held inside the body 102. A print head 306 and a roller 308 may be attached to a direction mechanism 310. An end of the paper 304 may be unrolled and passed by the print head 306 for printing. The roller 308 can be controlled to pull the paper 304 from the roll to advance the paper 304 past the print head 306 in a controlled manner for printing.

The direction mechanism 310 can be rotated either manually or by an electronic control mechanism to rotate between the positions shown in FIGS. 3 and 4 as shown for directing the paper 304 through either the opening 300 or the opening 302. The printer 102 may include a print operation manager 303 configured to operate an electronic control mechanism for rotating between the positions. The print operation manager 303 may have functionality described by the examples provided herein. For example, the paper 304 can be passed through either the opening 300 or the opening 302 in different print modes similar to the example described with respect to FIGS. 1 and 2 in which printed images are printed in different configurations. The print operation manager 303 may detect the different positions and control printing in the different configurations based on the detected positions.

The printer 100 may include moving cutter blades 312 and 314 positioned near respective openings 300 and 302. The print operation manager 303 may control the cutting blades 312 and 314 to cut the paper 304 at the end of a print operation. The cutting blades 312 and 314 may be individually controlled by the print operation manager 303 to cut the paper 304 based on the print configuration of the printer 100. For example, if the paper 304 is directed out of opening 302 and this mode is detected, the print operation manager 303 can control the cutter blade 314 to cut the paper 304. Further, if the paper 304 is directed out of opening 300 and this mode is detected, the print operation manager 303 can control the cutter blade 312 to cut the paper 304.

Figure 5:
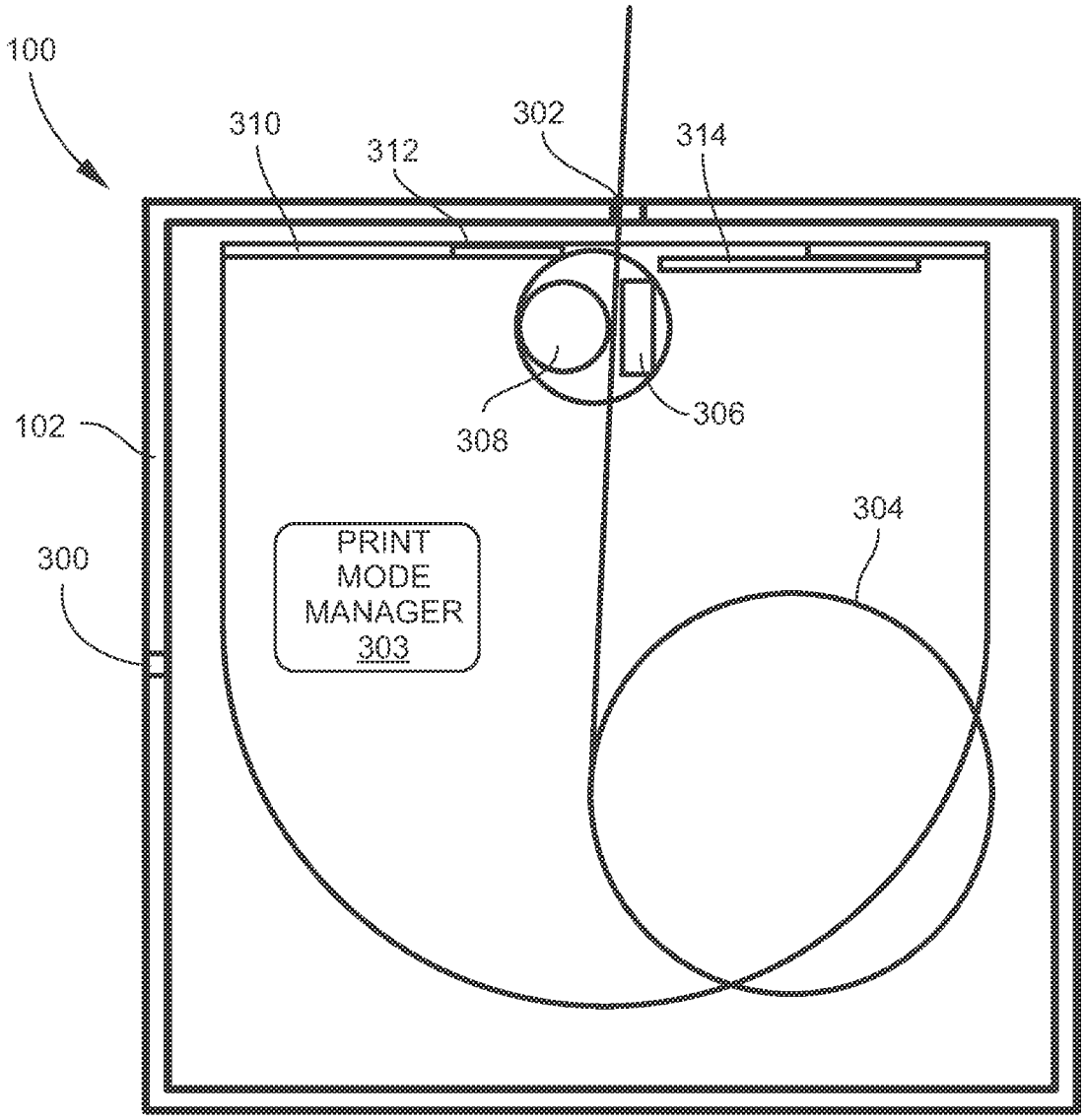
FIG. 5 illustrates a side cross section view of another printer in accordance with embodiments of the present invention.

FIG. 5 illustrates a side cross section view of another printer 100 in accordance with embodiments of the present invention. Referring to FIG. 5, the printer 100 includes the body 102 defining openings 300 and 302 on different sides of the body 102. A roll of paper 304 may be held inside the body 102. A print head 306 and a roller 308 may be attached to a direction mechanism 310. An end of the paper 304 may be unrolled and passed by the print head 306 for printing. The roller 308 can be controlled to pull the paper 304 from the roll to advance the paper 304 past the print head 306 in a controlled manner for printing.

The direction mechanism 310 can be rotated either manually or by an electronic control mechanism to rotate from the position shown in FIG. 5 for directing the paper 304 through either the opening 302 to a position such that the paper 304 can be directed through the opening 300. More particularly, the direction mechanism 310 may be rotated approximately 90 degrees within the body 102 such that the print head 306 and the roller 308 are near the opening 300 similar to how these components are near the opening 302 shown in FIG. 5. Removal of the direction mechanism 310 may be needed for rotation due to space constraints within the body 102. The paper 304 can be passed through either the opening 300 or the opening 302 in different print modes similar to the example described with respect to FIGS. 1 and 2 in which printed images are printed in different configurations.

The print operation manager 303 may have functionality described by the examples provided herein. For example, the paper 304 can be passed through either the opening 300 or the opening 302 in different print modes similar to the example described with respect to FIGS. 1 and 2 in which printed images are printed in different configurations. The print operation manager 303 may detect the different positions and control printing in the different configurations based on the detected positions.

The printer 100 may include a fixed cutter blade 312 and a moving cutter blade 314 for cutting the paper 304. The blades 312 and 314 can be attached to the direction mechanism 310 such that the blades can be positioned near openings 300 and 302 in respective print modes.

Figure 6:
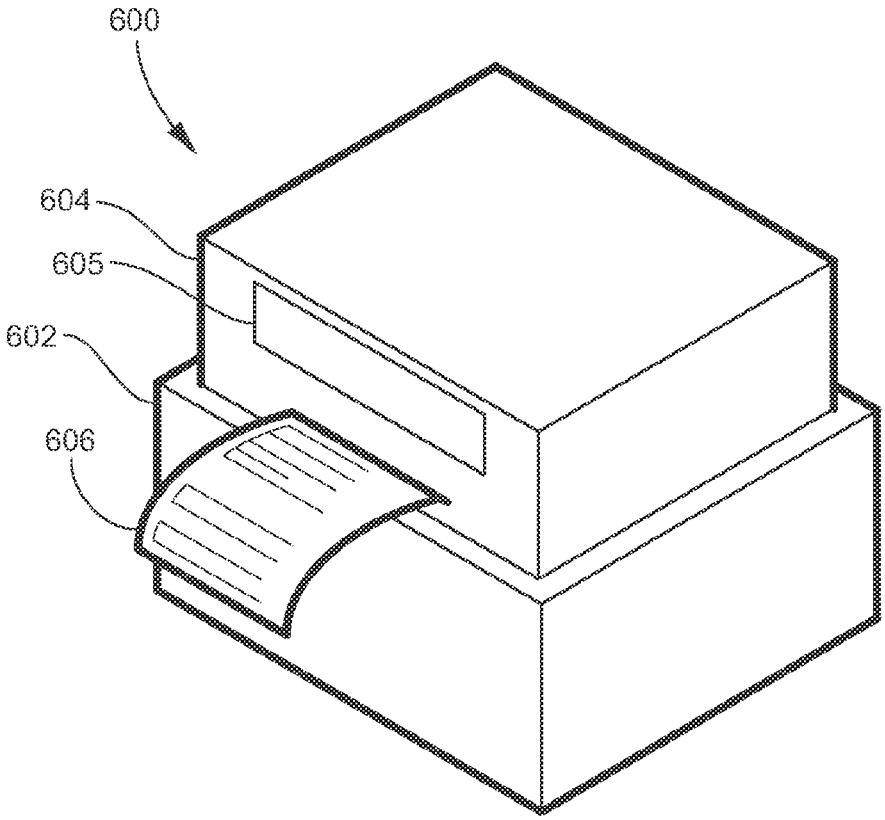
FIGS. 6 and 7 illustrate perspective views of a printer system in accordance with embodiments of the present invention.
Figure 7:
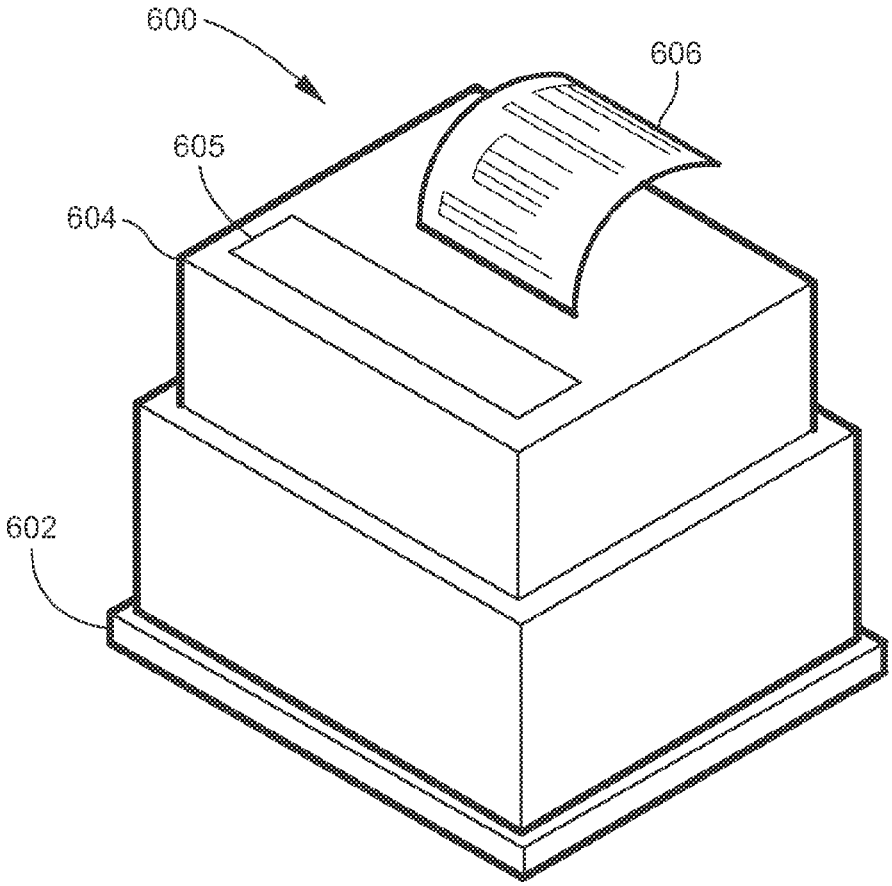

FIGS. 6 and 7 illustrate perspective views of a printer system 600 in accordance with embodiments of the present invention. Referring to FIG. 6, the printer system 600 includes a docking station 602 and a printer 604. The printer 604 includes a printer interface 605 and a printer holder defined to hold the printer 602 on two sides. FIG. 6 shows the printer 602 fitted into the docking station 602. FIG. 7 shows the printer 602 fitted into the docking station 602 on another side. In this way, the docking station 602 can carry the printer 604 in different positions such that the printed paper 606 can be dispensed from its side as shown in FIG. 6, and the printed paper 606 can be dispensed from its top as shown in FIG. 7. The printer 604 has a docking interface configured to interface with the docking station 602.

Figure 8:
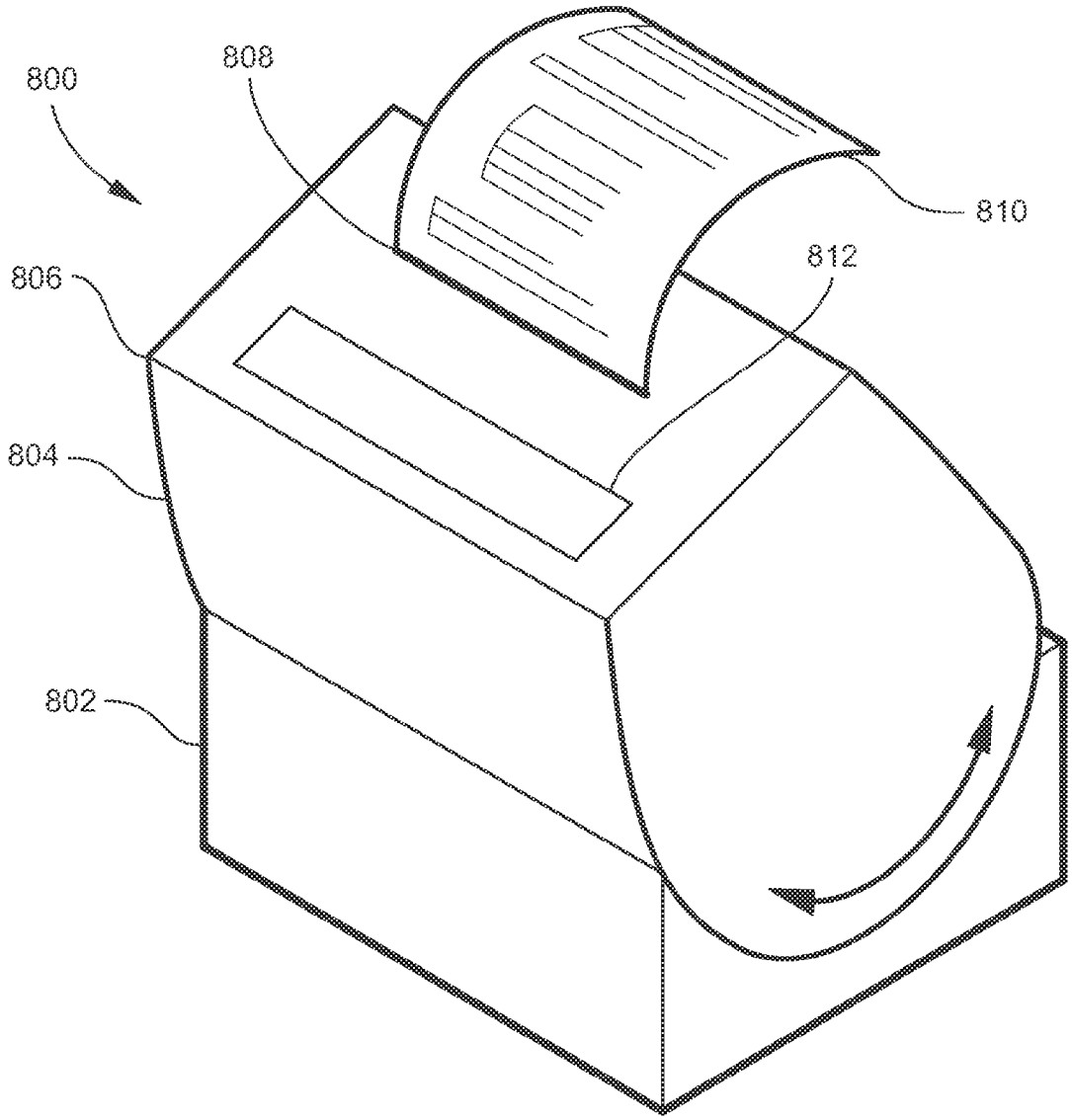
FIG. 8 illustrates a perspective view of a printer system in accordance with embodiments of the present invention.

FIG. 8 illustrates a perspective view of a printer system 800 in accordance with embodiments of the present invention. Referring to FIG. 8, the printer system 800 includes a docking station 802 and a printer 804. The docking station 802 includes a printer interface (not shown). The printer 804 includes a body 806 defining an opening 808 for dispense of printer paper 810.

The printer system 800 includes a rotation mechanism formed by interaction of the printer 804 and the docking station 802 for rotation of the printer 804 with respect to the docking station 802. In this way, the opening 808 can be faced in different directions when the printer 804 is rotated. The printer 804 includes a user interface 812, such as a display.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to diagrams according to embodiments of the invention. It will be understood that aspects and examples described herein can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the diagrams. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the diagrams illustration, and combinations of blocks in the diagrams, can be implemented by special purpose hardware-based systems that perform the specified functions or acts or carry out combinations of special purpose hardware and computer instructions.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A printer comprising:

a body defining one or more openings;

a print head;

a paper roll receiving unit configured to carry the paper roll and to unroll the paper roll for printing;

a direction mechanism configured to receive an unrolled end of the paper roll and to feed the unrolled end through the one or more openings; and a printing unit positioned within the body and configured to:

carry paper;

rotate the print head using the direction mechanism, wherein the print head is attached to the direction mechanism;

receive an instruction for printing an image;

operate in either a first print mode or a second print mode;

in the first print mode, print the image on the paper in a first configuration and dispense the paper in a first direction through the one or more openings of the body; and in the second print mode, print the image on the paper in a second configuration and dispense the paper in a second direction through the one or more openings of the body, the first and second configurations being different.

2. The printer of claim 1, wherein the printing unit is configured to generate a signal to indicate whether the printer is operating in the first print mode or the second print mode.

3. The printer of claim 1, further comprising:

a print head configured to print on the paper; and a feed mechanism configured to feed the paper near the print head for allowing the print head to print on the paper, wherein the instruction specifies a plurality of lines of text to print, wherein in the first print mode, the printing unit is configured to control the print head to print the lines in a first order and each line in a first orientation as the paper is fed past the print head, and wherein in the second print mode, the printing unit is configured to control the print head to print the lines in a second order and each line in a second orientation as the paper is fed past the print head, wherein the first and second order are different, and wherein the first orientation may oppose the second orientation.

4. The printer of claim 1, wherein the one or more openings include first and second openings, wherein the body includes first and second sides, wherein the first opening is defined in the first side, and wherein the second opening is defined in the second side.

5. The printer of claim 3, wherein the first and second sides are oriented substantially orthogonal with respect to each other.

6. The printer of claim 1, wherein the one or more openings include first and second openings, and wherein the printer further comprises a print operation manager configured to:

determine whether the paper is to be dispensed through the first opening or the second opening;

in response to determining that the paper is to be dispensed through the first opening, operating the printer in the first print mode; and in response to determining that the paper is to be dispensed through the second opening, operating the printer in the second print mode.

7. The printer of claim 1, further comprising a user interface configured to present print operation information and to receive user input for print operation control.

8. The printer of claim 7, wherein the user interface comprises a display configured to display the print operation information.

9. The printer of claim 8, wherein the user interface is configured to display the print operation information in a first orientation in the first print mode, and to display the print operation information in a second orientation in the second mode.

10. The printer of claim 1, wherein the printing unit is configured to automatically detect the print mode and provides a signal that is used to configure a user interface and print operation.

11. The printer of claim 1, wherein the print unit is configured to be manually set according to the print mode present and to provide a signal that is used to configure a user interface and print operation.

12. A method of printing, the method comprising:

providing a printer configured to carry a paper roll and unroll the paper roll for printing;

receiving the unrolled end of the paper roll and feeding the unrolled end of the paper roll through one or more openings of a body of the printer;

providing a print head configured to print on the unrolled end of the paper roll;

providing a direction mechanism configured to rotate the print head;

receiving an instruction for printing an image;

determining whether to operate in either a first print mode or a second print mode;

rotating the print head using the direction mechanism wherein the print head is attached to the said direction mechanism;

in the first print mode, printing the image on the unrolled end of the paper roll in a first configuration and dispensing the paper in a first direction through the one or more openings of the body of the printer; and in the second print mode, printing the image on the paper in a second configuration and dispensing the paper in a second direction through the one or more openings of the body of the printer, the first and second configurations being different.

13. The method of claim 12, further comprising:

feeding the paper near a print head for allowing the print head to print on the paper, wherein the instruction specifies a plurality of lines of text to print;

in the first print mode, controlling the print head to print the lines in a first order and each line in a first orientation as the paper is fed past the print head; and in the second print mode, controlling the print head to print the lines in a second order and each line in a second orientation as the paper is fed past the print head, wherein the first and second order are opposites, and wherein the first orientation opposes the second orientation.

14. The method of claim 12, wherein the one or more openings include first and second openings, wherein the body includes first and second sides, wherein the first opening is defined in the first side, and wherein the second opening is defined in the second side.

15. The method of claim 14, wherein the first and second sides are oriented substantially orthogonal with respect to each other.

16. The method of claim 12, wherein the one or more opening comprises first and second openings, and wherein the method further comprises:

determining whether the paper is to be dispensed through a first opening or a second opening;

in response to determining that the paper is to be dispensed through the first opening, operating the printer in the first print mode; and in response to determining that the paper is to be dispensed through the second opening, operating the printer in the second print mode.

17. The method of claim 12, further comprising using a user interface to present print operation information and to receive user input for print operation control.

18. The method of claim 17, further comprising controlling a display to display the print operation information.

19. The method of claim 17, further comprising controlling the user interface to display the print operation information in a first orientation in the first print mode, and to display the print operation information in a second orientation in the second mode.

* * * * *